US012553244B1

(12) United States Patent
Patton et al.

(10) Patent No.: US 12,553,244 B1
(45) Date of Patent: Feb. 17, 2026

(54) PROTECTIVE AWNING

(71) Applicants: Najee Patton, Park City, KS (US); Owen Bolan, Park City, KS (US)

(72) Inventors: Najee Patton, Park City, KS (US); Owen Bolan, Park City, KS (US)

( * ) Notice: Subject to any disclaimer, the term of this patent is extended or adjusted under 35 U.S.C. 154(b) by 161 days.

(21) Appl. No.: 18/449,884

(22) Filed: Aug. 15, 2023

Related U.S. Application Data

(60) Provisional application No. 63/529,923, filed on Jul. 31, 2023, provisional application No. 63/399,548, filed on Aug. 19, 2022.

(51) Int. Cl.
*E04F 10/04* (2006.01)

(52) U.S. Cl.
CPC ..... *E04F 10/04* (2013.01)

(58) Field of Classification Search
CPC ..... E04H 6/04; E04H 6/025; E04F 10/0633; E04F 10/04; E04F 10/0662
See application file for complete search history.

(56) References Cited

U.S. PATENT DOCUMENTS 233,988 A * 11/1880 Cook ..... E04F 10/0614 160/908
363,155 A * 5/1887 Mason ..... E04F 10/0614 160/908
363,549 A * 5/1887 Schweckendiek .. E04F 10/0614 454/196
468,942 A * 2/1892 Kirk ..... E04F 10/02 160/908
550,847 A * 12/1895 Seick ..... E04F 10/02 160/81
615,174 A * 11/1898 Hettrick ..... E04F 10/02 160/81
770,499 A * 9/1904 Johnson ..... E04F 10/02 160/907
1,050,340 A * 1/1913 Christian ..... E04F 10/0614 160/65
1,545,224 A * 7/1925 Whealdon ..... E04F 10/04 160/105
1,572,790 A * 2/1926 Grigsby ..... E04H 6/04 52/67
1,677,581 A * 7/1928 Cohen ..... E04F 10/02 135/117

(Continued)

FOREIGN PATENT DOCUMENTS

AT 16585 U1 2/2020
DE 202018100693 U1 4/2018

(Continued)

*Primary Examiner* — Johnnie A. Shablack
(74) *Attorney, Agent, or Firm* — John Rizvi, P.A.—The Patent Professor ®; John Rizvi

(57) ABSTRACT

A protective awning is provided for use in a commercial establishment. The protective awning includes a collapsible frame assembly, an awning cover covering the collapsible frame assembly and a support frame for securing the collapsible frame assembly to a building. A release mechanism is provided to allow the collapsible frame assembly to move from a rigid condition holding the collapsible frame assembly away from the building to a collapsed condition closer to the building. A break-away mechanism is provided to prevent damage to the protective awning and building in the event of impact from a vehicle.

20 Claims, 5 Drawing Sheets

(56) References Cited

U.S. PATENT DOCUMENTS 1,688,010 A * 10/1928 Godske ..... E04F 10/0618 248/278.1
1,938,140 A * 12/1933 Elisius ..... E04F 10/02 160/81
2,082,777 A * 6/1937 Brent ..... E04F 10/10 160/907
2,249,865 A * 7/1941 Skyum ..... E04F 10/02 12/142 F
2,566,459 A * 9/1951 McCoy ..... E04F 10/02 403/150
2,578,964 A * 12/1951 Bell ..... E04F 10/02 160/81
3,298,422 A * 1/1967 Ruiz ..... E04F 10/04 160/134
3,324,869 A * 6/1967 Duda ..... E04F 10/0625 135/88.12
4,171,013 A * 10/1979 Clark ..... E04F 10/0614 135/904
5,390,719 A * 2/1995 Barnes ..... E04H 14/00 160/46
5,597,006 A * 1/1997 Simonetti ..... B60P 3/343 92/61
6,273,115 B1 * 8/2001 Guggisberg ..... E04H 15/38 52/63
6,457,508 B1 * 10/2002 Tomita ..... E06B 9/40 160/67
6,732,018 B2 * 5/2004 Osinga ..... E04F 10/0688 318/16
7,086,684 B2 * 8/2006 Glaser ..... B60J 11/00 296/99.1
8,528,254 B1 * 9/2013 Johnston ..... E06B 9/04 49/67
10,544,591 B1 * 1/2020 Leon ..... E04F 10/0685
2018/0051466 A1 * 2/2018 Guggisberg ..... E04F 10/04

FOREIGN PATENT DOCUMENTS

JP 2007303065 A 11/2007
WO 2013025249 A1 2/2013

* cited by examiner

PROTECTIVE AWNING

CROSS-REFERENCE TO RELATED APPLICATIONS

This application claims the benefit of U.S. Provisional Patent Application Ser. No. 63/399,548, filed on Aug. 19, 2022, and U.S. Provisional Patent Application Ser. No. 63/529,923, filed on Jul. 31, 2023, both of which are incorporated by reference herein in their entireties.

FIELD OF THE INVENTION

The present invention relates generally to window awnings, and more particularly, to a movable awning for protecting the awning and supporting building from damage from a vehicle.

BACKGROUND OF THE INVENTION

Awnings are typically provided over windows or other openings in commercial establishment buildings to cover and protect an employee working through the window as well as customers in vehicles located in the adjacent drive-through lanes. These situations typically include bank teller windows, fast food restaurant drive-through windows, pharmacy service drive-through windows and the like.

The awnings typically include a frame assembly covered by a fabric cover and attached to the building by a support frame. The awnings extend out over the drive-through lanes and are positioned a specific height above the drive through lanes.

Problems can arise if a vehicle is too tall to safely pass under the awning resulting in damage to the awning. Should the vehicle impact the awning with sufficient force, possible damage to the supporting building may occur as well. This may occur while the establishment is open for business and the drive-through window manned by an employee or after business hours when no employees are present.

Accordingly, there is need for a solution to at least one of the aforementioned problems. For instance, there is an established need for protective awning that can be easily collapsed against the supporting building during non-business hours. There is a further established need for a protective awning that can automatically collapse upon impact from a vehicle to protect both the protective awning and the supporting building.

SUMMARY OF THE INVENTION

The present invention is directed to a protective awning for use in a commercial establishment. The protective awning includes a collapsible frame assembly, an awning cover covering the collapsible frame assembly and a support frame for securing the collapsible frame assembly to a building. A release mechanism is provided to allow the collapsible frame assembly to move from a rigid condition holding the collapsible frame assembly away from the building to a collapsed condition closer to the building. A break-away mechanism is provided to prevent damage to the protective awning and building in the event of impact from a vehicle.

In a first implementation of the invention, a protective awning for use in a commercial establishment is provided, the protective awning comprising:

a frame support for attaching the protective awning to a wall of a building;

a collapsible frame assembly attached to said frame support by hinges, said collapsible frame assembly including a first horizontal channel member, a second horizontal channel member, a first angled channel member, a second angled channel member and a front channel member, said collapsible frame assembly movable between a rigid condition wherein said first angled channel member is in a fixed condition with said front channel member and a collapsed condition wherein said first horizontal channel member is pivoted relative to said front channel member;

an awning cover attached to said collapsible frame assembly; and a release mechanism attached to said collapsible frame assembly, said released mechanism including a release pin, engagable with a hinge of said collapsible frame assembly, and a tensioning spring attached to said collapsible frame assembly and said release pin, wherein said first horizontal channel member is pivotally affixed to said front bar and said release pin secures said first horizontal channel member to said front bar in the rigid condition.

In a second aspect, the frame support includes a top bar and a bottom bar, the first and second horizontal channel member extending between the bottom bar and the front channel member and the first and second angled channel members extending between the top bar and the front channel member.

In another aspect, the release mechanism further includes a cable, the release pin being connected to the tensioning spring by the cable.

In another aspect, the cable is routed around a pulley connected to said frame support.

In another aspect, the release mechanism further includes a lock box mounted on said first horizontal channel member, the release pin being in movable engagement with said lock box to secure and release the first channel member from the rigid condition with said front channel member.

In another aspect, the protective awning further includes a breakaway mechanism attached to the collapsible frame assembly, the breakaway mechanism including a hinge having a first plate and a second plate and a breakable pin positioned in the hinge, wherein said breakable hinge secures said second plate in a right angle relative to said first plate and releases said second plate for movement relative to said first plate when said breakable pin is broken due to impact to the collapsible frame assembly.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a safety awning having quick release and break-away mechanisms to allow the awning to collapse upon impact.

Figure 1:
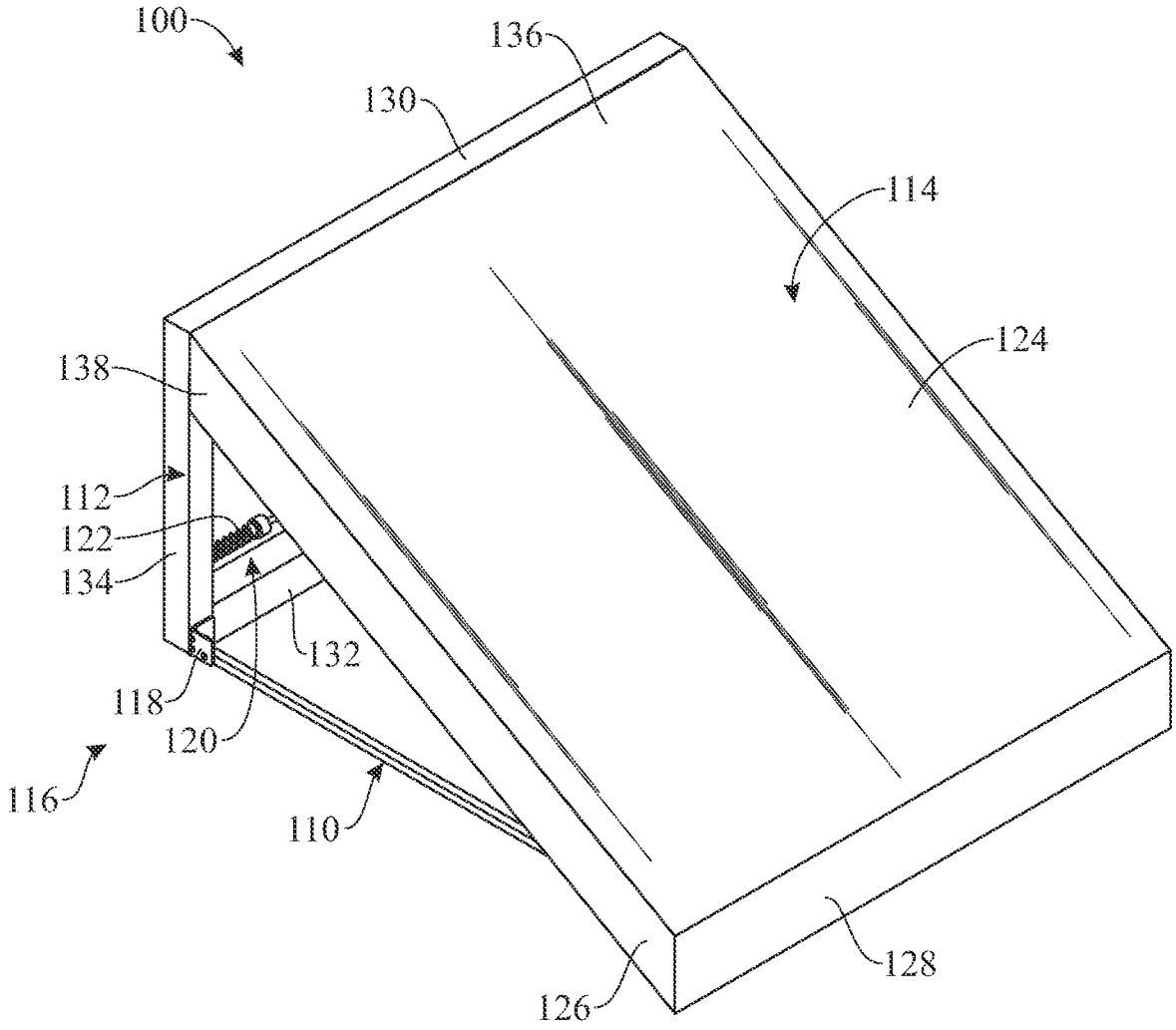
FIG. 1 presents a top front isometric view of a protective awning for use with a building in accordance with an exemplary illustrative embodiment of the present invention.

Referring to FIGS. 1-5, and initially with regard to FIG. 1, a protective or collapsible safety awning, hereinafter protective awning 100, is illustrated in accordance with a first exemplary embodiment of the present invention. The protective awning 100 generally includes a collapsible frame assembly 110, a frame support 112 and an awning cover 114. The collapsible frame assembly 110 supports the awning cover 114 over a roadway and the frame support 112 supports the collapsible frame assembly 110 on a wall of a building (not shown).

The collapsible frame assembly 110 is movably connected to the frame support 112 by a pivoting hinge assembly 116. The pivoting hinge assembly 116 includes a series of bottom support hinges 118 that allow the collapsible frame assembly 110 to pivot sideways relative to the frame support 112 and the building the protective awning 100 is attached to, in the event the collapsible frame assembly 100 is impacted by vehicle as discussed in more detail hereinbelow.

A release mechanism 120, having a tensioning spring 122, is connected to the collapsible frame assembly 110. The release mechanism 120 is operable to maintain the collapsible frame assembly 110 in a first or rigid condition in the absence of any impact to the collapsible frame assembly 110 and allow the pivoting hinge assembly 116 to pivot to a second or collapsed condition when the collapsible frame assembly 110 is impacted by a vehicle.

The awning cover 114 is of the type typically covering a take-out window in a commercial establishment such as, for example, bank or pharmacy drive up windows, fast food restaurant drive up or take out windows and the like. It can be made of any material such as canvas, fiberglass, polymer material, e.g., acrylic or vinyl, metal, or glass. The awning cover 114 generally includes a top panel 124, side panels 126 and a front panel 128.

The frame support 112 generally includes a top bar 130, a bottom bar 132 and a first side bar 134. The top bar 130, the bottom bar 132 and the first side bar 134 are fixedly connected to a wall of a building (not shown) to support the collapsible frame assembly 110 and awning cover 114 over a roadway or drive-through lane in front of a commercial establishment take-out window and the like.

The awning cover 114 is draped over and secured about the collapsible frame assembly 110 in a known manner. For example, a rear edge 136 of the top panel 124 is secured to the top bar 130 of the frame support 112 while a rear edge 138 of the side panel 126 are secured to the first side bar 134. The generally box like shape of the awning cover 114 holds the awning cover 114 tightly over the collapsible frame assembly 112. Additionally, internal tie downs (not shown) may be provided to further secure the awning cover 114 to the collapsible frame assembly 112.

The awning cover 114 may be formed from a variety of soft or flexible materials such as, for example, cotton or canvas, various polymeric materials, natural materials such as jute, reed grasses, etc. The soft or flexible nature of the material forming the awning cover 114 allows the awing cover 114 to flex or move with the collapsible frame assembly 112 when the collapsible frame assembly 114 is moved from the first or rigid condition to the second or collapsed condition to prevent damage to the awning cover 114. While not specifically shown, the awing cover 114 may be provided with decorative colors, images, etc. and with informative lettering such as, for example, "Drive Up Window", establishment name, directions to pay at this window and the like.

Figure 2:
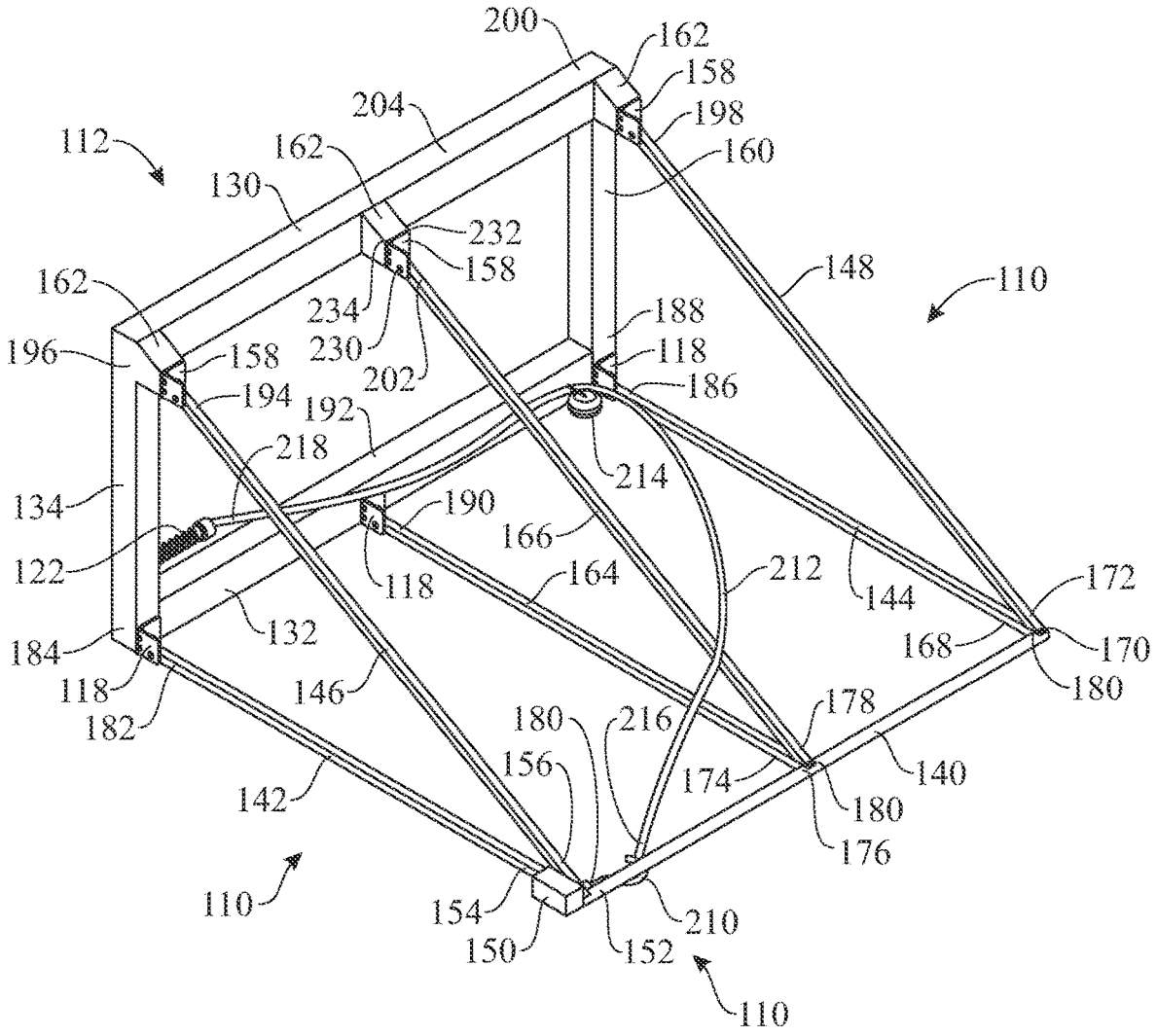
FIG. 2 presents a top front isometric view of the protective awning illustrated in FIG. 1 with an awning cover removed.

Referring now to FIG. 2, the collapsible frame assembly 112 generally includes a main or front channel member 140, first and second horizontal channel members 142 and 144 and first and second angled channel members 146 and 148, respectively. The release mechanism 120 further includes a lock box 150 which assists in holding the collapsible frame assembly 112 in the first or rigid condition. The lock box 150 is positioned on the front channel member 140 at a first end 152 of the front channel member 140. The lock box 150 assists in rigidly securing the first end 152 of the front channel member 140 to first ends 154 and 156 of the first horizontal channel member 142 and the first angled channel member 146, respectively.

As noted above, the pivoting hinge assembly 116 of the collapsible frame assembly 110 allows the collapsible frame assembly 112 to move between the first or rigid condition and the second or collapsed condition in the event of an impact to the collapsible frame assembly 110. Additionally, a user can also activate the release mechanism 120 to allow the collapsible frame assembly 110 to move to the collapsed condition for storage when the establishment is closed or other conditions.

The pivoting hinge assembly 116 includes the bottom support hinges 118 and top support hinges 158. Together, the bottom support hinges 118 and the top support hinges 158 allow the collapsible hinge assembly 110 to move relative to the frame support 112. Movement of collapsible hinge assembly 110 relative to the frame support 112 can in one embodiment include movement of the collapsible hinge assembly 110 from a position of being perpendicular to the frame support 112 to a position wherein it is parallel thereto. The frame support 112 further includes a second side bar 160. The top bar 130 include projecting hinge mounts 162 to support the top support hinges 158.

In addition to the first and second horizontal channel members 142 and 144, respectively, the collapsible frame assembly 110 may be provided with one or more intermediate horizontal channel members 164 to stiffen the collapsible frame assembly 110. Likewise, in addition to the first and second angled channel members 146 and 148, the collapsible frame assembly 110 may be provided with one or more intermediate angled channel members 166 to stiffen the collapsible frame assembly 110 as well as lend further support for the awning cover 114.

As shown, a first end 168 of the second horizontal channel member 144 is movably connected to a second end 170 of the front channel member 140. A first end 172 of the second angled channel member 148 is likewise movably connected to the second end 170 of the front channel member 140. Similarly, a first end 174 of the intermediate horizontal channel member 164 is movably connected to an intermediate point 176 of the front bar 140 and a first end 178 of the intermediate angled channel member 166 is also movably connected to the intermediate point 176 of the front channel member 140.

In a particular embodiment, the first end 154 of the first horizontal channel member 142 and the first end 156 of the first angled channel member 146 are connected to the first end 152 of the front bar 140 by a hinge or pivot pin 180. First ends 168 and 172 of the second horizontal channel member 144 and the second angled channel member 148 are likewise connected to the second end 170 of the front bar 140 by hinge or pivot pin 180. The first ends 174 and 178 of the intermediate horizontal channel member 164 and the intermediate channel member 166 are similarly connected to the intermediate point 176 of the front bar 140 with the hinge or pivot pin 180.

A second end 182 of the first horizontal channel member 142 is connected to a bottom support hinge 118 mounted to a bottom end 184 of the first side bar 134 of the frame support 112. Similarly, a second end 186 of the second horizontal channel member 144 is connected to a bottom support hinge 118 mounted to a bottom end 188 of the second side bar 160 of the frame support 112. A second end 190 of the intermediate horizontal channel member 164 is connected to a bottom support hinge 118 mounted to an intermediate point 192 on the bottom bar 132 of the frame support 112.

A second end 194 of the first angled channel member 146 is mounted to a top hinge 158 attached to the hinge support 162 extending from a top end 196 of the first side bar 134 of the frame support 112. A second end 198 of the second angled channel member 148 is mounted to the top hinge 158 attached to the hinge support 162 extending from a top end 200 of the second side bar 160. A second end 202 of the intermediate angled channel member 166 is mounted to a the top hinge 158 extending from the hinge support 162 extending from an intermediate point 204 of the top bar 130 of the frame support 112.

Figure 3:
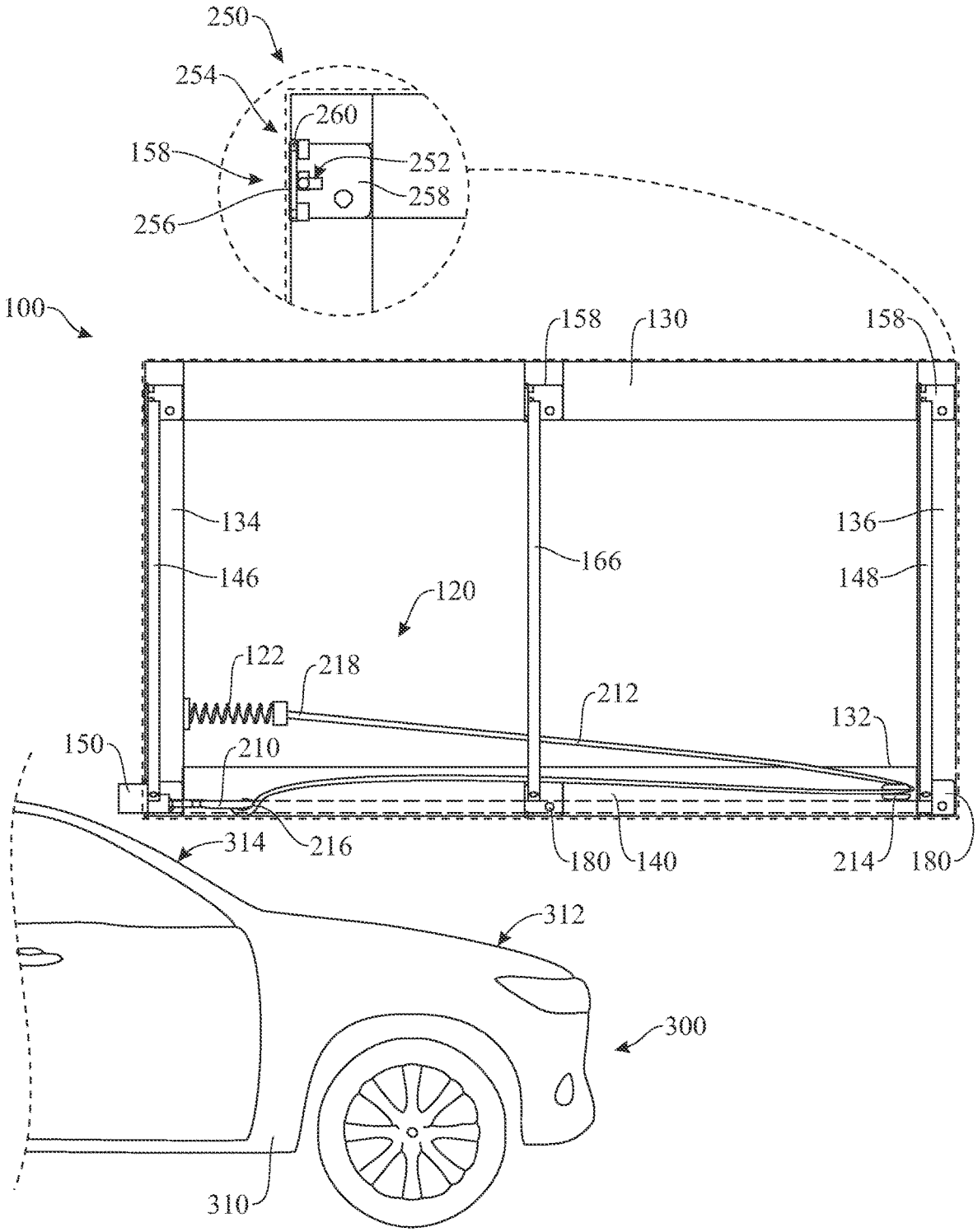
FIG. 3 presents a side plan view, partially shown in section, of the protective awning with a vehicle positioned adjacent to the protective awning.

Referring now to FIGS. 2 and 3, and as noted hereinabove, the release mechanism 120 is provided to allow a user to collapse the protective awning 100 for storage and to prevent damage to the awning due to impact by vehicles. The release mechanism 120 includes a release pin 210 which is insertable into the lock box 150 to secure the first horizontal channel member 142 of the collapsible frame assembly 110 to the front bar 140 in a right angle orientation. This prevents the entire collapsible frame assembly 110 from pivoting about the bottom and top support hinges 118 and 158, respectively. Thus, the protective awning 100 is locked into the first or rigid condition.

Removing or withdrawing the release pin 210 from within the lock box 150 frees the first horizontal channel member 142 from the rigid condition relative to the front bar 140. This allows the first horizontal channel member 142 to pivot relative to the front bar 140 about the hinge or pivot pin 180. Thus, the remainder of the collapsible frame assembly 110 can pivot about the bottom and top support hinges 118 and 158, respectively, and the pivot hinges or pins 180.

The release mechanism 120 further includes a cable 212 attached to and extending between the tensioning spring 122 and the release pin 210. The tensioning spring 122 is attached to the first side bar 134. The release mechanism 120 further includes a pulley 214, attached to the bottom bar 132. A first end 216 of the release cable 212 is attached to the release pin 210 and a second end 218 of the release cable 212 is attached to the tensioning spring 122. The release cable 212 is routed around the pulley 214. The tensioning spring 122 places tension on the release cable 212 and thus on the release pin 210. By pulling on the release cable 212, a user can withdraw the release pin 210 from the lock box 150 to collapse the protective awning 100 for storage.

Figure 4:
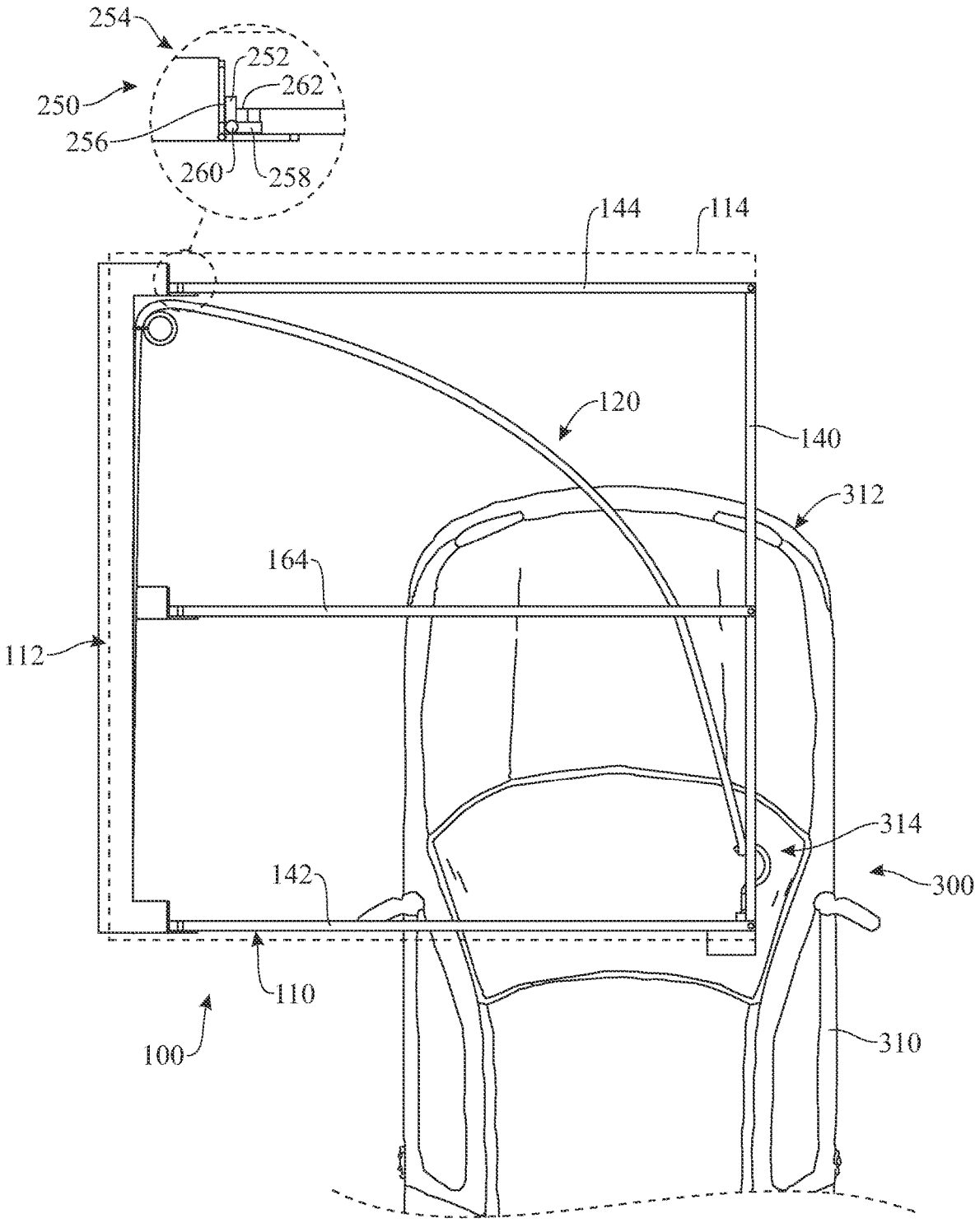
FIG. 4 presents a top plan view of the protective awning immediately prior to impact from the vehicle.
Figure 5:
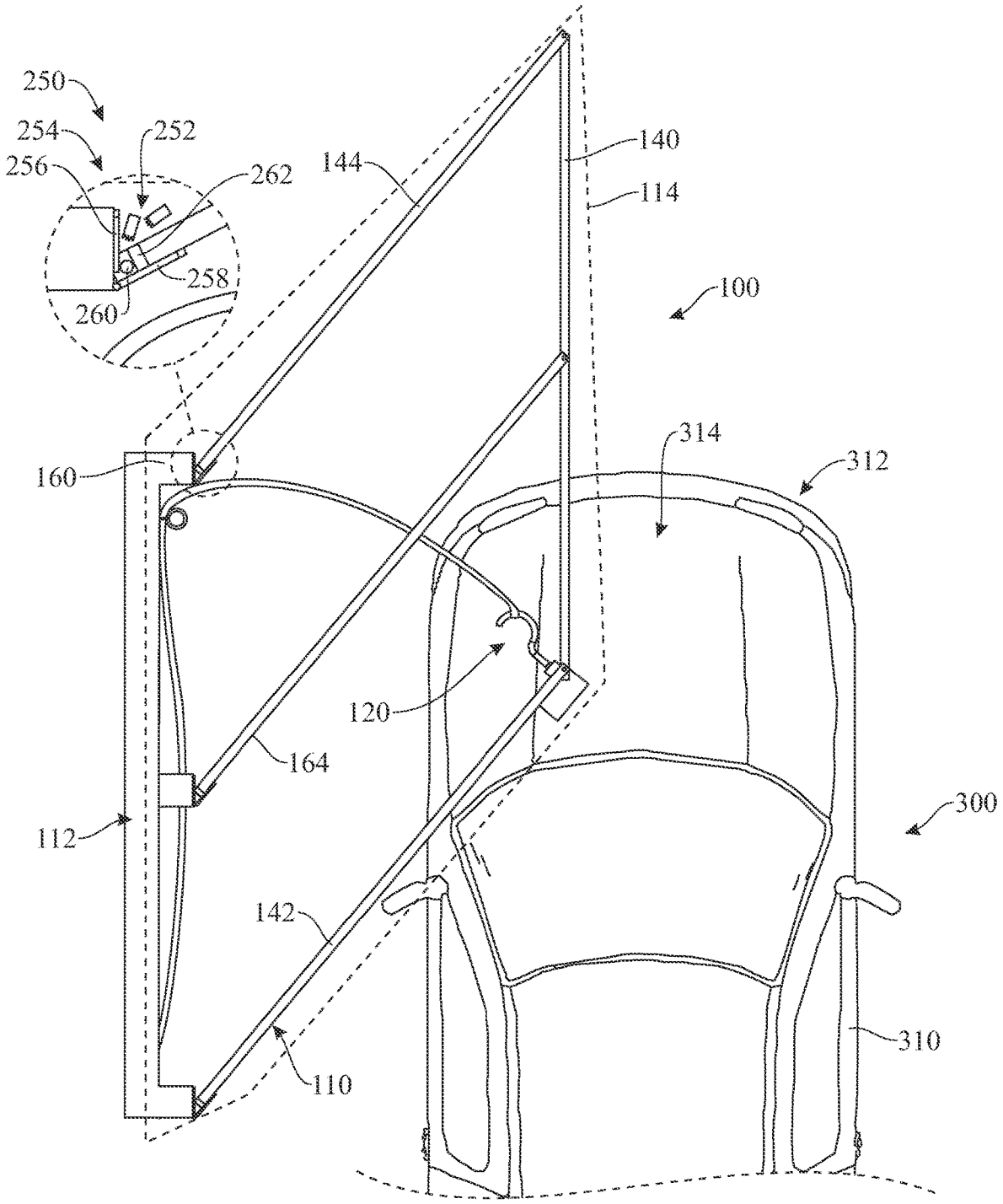
FIG. 5 presents a top plan view of the protective awning upon impact from the vehicle.

Turning now to FIGS. 3-5, and initially with regard to FIGS. 3 and 4, in use, the protective awing 100 can be pivoted to the collapsed condition for storage as described hereinabove. The protective awning 100 is provided to be used in a driveway or road adjacent to building that received vehicular traffic from vehicles such as, for example, vehicle 300. Vehicle 300 generally includes a vehicle frame 310 having a nose 212 and a windshield 314. Impact to an extended awning by the nose 312 or windshield 314 of the vehicle 300 can cause damage to both the awning and the building to which the awning is attached.

The protective awning 100 is designed to move to the collapsed condition upon engagement of the collapsible frame 110 by the vehicle 300. For example, should the windshield 214 of the vehicle 300 engage the lock box 150, the collapsible frame 110 will start to bend or move i.e., shift about the bottom and top support hinges 118 and 158, respectively. As the collapsible frame 110 starts to shift or flex, the tension on the release cable 212 of the release mechanism 120 increases causing the release pin 210 to withdraw from the lock box 150. As the release pin 210 is withdrawn from the lock box 150, the first horizontal channel member 142 is release from the rigid condition with the front bar 140 and the entire collapsible awning is free to pivot about the bottom and top support hinges 118 and 158, respectively, and the pivot hinges or pivot pins 180 (FIG. 5).

It should be noted that, as best shown in FIG. 2, the bottom and top support hinges 118 and 158, respectively, are angle iron type hinges. For example, the center top support hinge 158 is an angle iron type hinge having two flat plates 230 and 232 pivotally joined by a common pivot pin 234 and initially at a right angle to each other in the rigid condition. The two flat plates 230 and 232 are movable between the right angle or rigid condition and a parallel or substantially parallel to each other collapsible condition.

As best shown in FIGS. 3,4 and 5, the protective awning 100 further includes a break-away mechanism 250 that allows one or more of the bottom and/or top support hinges 118 and/or 158 to break free of the rigid condition in the event of a dramatic impact to the protective awning by the vehicle 300. In this embodiment, one or more of the bottom and/or top support hinges 118, 158, respectively, for example one of the top support hinges 158 (FIG. 3) is formed as a breakaway hinge having a breakable pin 252 positioned in a breakable hinge 254. The breakable hinge 154 includes a first plate 256, a second plate 258 and a pivot pin 260. The breakable pin 252 is initially positioned within a bore 262 in one of the first or second plates 256 and 258, respectively.

As best shown in FIG. 5, the breakaway mechanism 250 has replaced a bottom support hinge 118 between the bottom end 188 of the second side bar 160 and the second end 186 of the second horizontal channel member 144. As the vehicle 300 impacts the collapsible frame 110 of the protective awning, the collapsible frame 110 starts to move or flex. The movement of the collapsible frame 110 includes movement of the second horizontal channel member 144. As the second channel member 144 starts to move, it moves the second plate 258 such that the breakable pin 252 in the bore 262 of the second plate 258 breaks and frees the first and second plates 256 and 258, respectively, and therefore the second horizontal channel member 144, for movement. Thus, the provision of the break-away mechanism 250 allows the entire protective awning 100 to pivot preventing damage to both the protective awning and the supporting building in the event of a forceful impact to the protective awning.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A protective awning for use in a commercial establishment, the protective awning comprising:

a frame support for attaching the protective awning to a wall of a building;

a collapsible frame assembly attached to said frame support by hinges, said collapsible frame assembly including a first horizontal channel member, a second horizontal channel member, a first angled channel member, a second angled channel member and a front channel member, said collapsible frame assembly movable between a rigid condition wherein said first angled channel member is in a fixed condition with said front channel member and a collapsed condition wherein said first horizontal channel member is pivoted relative to said front channel member;

an awning cover attached to said collapsible frame assembly; and a release mechanism attached to said collapsible frame assembly, said release mechanism including a release pin engageable with a hinge of said collapsible frame assembly and a tensioning spring attached to said collapsible frame assembly and said release pin, wherein said first horizontal channel member is pivotally affixed to said front bar and said release pin secures said first horizontal channel member to said front bar in the rigid condition.

2. The protective awning of claim 1, wherein the frame support includes a top bar and a bottom bar, the first and second horizontal channel members extending between the bottom bar and the front channel member and the first and second angled channel members extending between the top bar and the front channel member.

3. The protective awning of claim 2, wherein the awning cover includes a top panel, two side panels, and a front panel.

4. The protective awning of claim 3 wherein, a rear edge of the top panel is secured to the top bar of the frame support and a rear edge of the side panel is secured to a first side bar.

5. The protective awning of claim 1, wherein the release mechanism further includes a cable, the release pin being connected to the tensioning spring by the cable.

6. The protective awning of claim 5, wherein a first end of the cable is attached to the release pin and a second opposing end of the cable is attached to the tensioning spring.

7. The protective awning of claim 1, wherein the cable is routed around a pulley connected to the frame support.

8. The protective awning of claim 1, wherein the release mechanism further includes a lock box mounted on said first horizontal channel member, the release pin being in movable engagement with the lock box to secure and release the first channel member from the rigid condition with said front channel member.

9. The protective awning of claim 1, wherein the tensioning spring is configured to place tension on the release cable and on the release pin.

10. The protective awning of claim 1, further comprising a breakaway mechanism attached to the collapsible frame assembly, the breakaway mechanism including a hinge having a first plate and a second plate, and a breakable pin positioned in the hinge, wherein said breakable pin secures said second plate in a right angle relative to said first plate and releases said second plate for movement relative to said first plate when said breakable pin is broken due to impact to the collapsible frame assembly.

11. The protective awning of claim 1, wherein the collapsible frame assembly is movably connected to the frame support by a pivoting hinge assembly containing the hinges.

12. The protective awning of claim 1, wherein the hinges are angle iron-type hinges.

13. The protective awning of claim 1, wherein the collapsible frame assembly is movably connected to the frame support by a pivoting hinge assembly.

14. The protective awning of claim 1, wherein the collapsible frame assembly further contains one or more intermediate horizontal channel members to stiffen the collapsible frame assembly.

15. The protective awning of claim 1, wherein the collapsible frame assembly further contains one or more intermediate angled channel members to stiffen the collapsible frame assembly.

16. The protective awning of claim 1 wherein the awning is made of a material selected from the group consisting of cotton, canvas, fiberglass, a polymer material, metal, and glass.

17. The protective awning of claim 1 wherein the awning cover is draped over and secured about the collapsible frame assembly.

18. The protective awning of claim 1, further comprising internal tie downs which are configured to secure the awning cover to the collapsible frame assembly.

19. The protective awning of claim 1, wherein the collapsible frame assembly is configured such that the collapsible frame assembly moves between a first or rigid condition and a second or collapsed condition in the event of an impact to the collapsible frame assembly.

20. The protective awning of claim 1, wherein the collapsible frame assembly is configured such that the collapsible frame assembly moves between a first or rigid condition and a second or collapsed condition when the release mechanism is activated.

* * * * *